United States Patent [19]

Hansen et al.

[11] Patent Number: 4,785,837

[45] Date of Patent: Nov. 22, 1988

[54] CEILING SUSPENDED BED CANOPY

[75] Inventors: Victoria S. Hansen; Oleen J. Hansen, both of 5840 S. W. 205, Aloha, Oreg. 97007; Millie J. Laferriere, Aloha, Oreg.

[73] Assignee: Victoria and Oleen Hansen, Aloha, Oreg.

[21] Appl. No.: 96,225

[22] Filed: Sep. 8, 1987

Related U.S. Application Data

[63] Continuation of Ser. No. 822,572, Jan. 27, 1986, abandoned.

[51] Int. Cl.[4] ..... E04H 15/04; A47C 29/00

[52] U.S. Cl. ..... 135/90; 135/87; 5/414

[58] Field of Search ..... 135/87, 90, 21, 902, 135/DIG. 1, DIG. 8; 5/113, 163, 414; 27/2, 3, 4

[56] References Cited

U.S. PATENT DOCUMENTS

| | | | |
|---|---|---|---|
| 144,193 | 11/1873 | Elliott | 135/90 |
| 203,291 | 5/1878 | Rhodes | 5/414 X |
| 390,008 | 9/1888 | Darley | 5/414 X |
| 435,191 | 8/1890 | Sarrazin | 5/414 |
| 447,842 | 3/1891 | Partridge | 135/90 |
| 506,885 | 10/1893 | Puckette | 5/414 |
| 544,871 | 8/1895 | Turner | 135/90 |
| 654,156 | 7/1900 | Johnson | 135/90 |
| 671,912 | 4/1901 | Woodward | 135/90 |
| 823,814 | 6/1906 | Scherff | 135/90 X |
| 827,753 | 8/1906 | Russegue | 135/90 X |
| 1,285,766 | 11/1918 | Martin | 135/90 |
| 1,759,628 | 5/1930 | Pellegrino | 135/90 |
| 3,164,880 | 1/1965 | Hotchkiss | 27/7 X |
| 3,283,386 | 11/1966 | Cenegy | 27/7 X |
| 3,821,822 | 7/1974 | Borreggine | 5/414 X |
| 3,969,798 | 7/1976 | Sahlin | 27/4 |
| 4,010,973 | 3/1977 | Heinrich | 135/90 X |
| 4,074,377 | 2/1978 | Gutner | 5/414 |
| 4,607,401 | 8/1986 | Sisson | 5/414 |
| 4,657,037 | 4/1987 | Garrido et al. | 135/90 |
| 4,729,137 | 3/1988 | Denney | 5/414 |

FOREIGN PATENT DOCUMENTS

| | | | |
|---|---|---|---|
| 406981 | 12/1924 | Fed. Rep. of Germany | 27/2 |
| 3234715 | 7/1983 | Fed. Rep. of Germany | 27/4 |
| 470179 | 5/1969 | Switzerland | 27/2 |

OTHER PUBLICATIONS

Illustrated Catalog, Mosquito Canopies, I. E. Palmer Co., 1911, Middletown, Conn.

*Primary Examiner*—Robert A. Hafer
*Assistant Examiner*—D. Neal Muir
*Attorney, Agent, or Firm*—Eugene M. Eckelman

[57] ABSTRACT

An arched body portion is supported by line means to hang from a ceiling over a bed so as to form a canopy independent of the bed. The body portion preferabley is constructed of rigid board material having novel joint sections forming the arched configuration.

2 Claims, 1 Drawing Sheet

FIG. 1
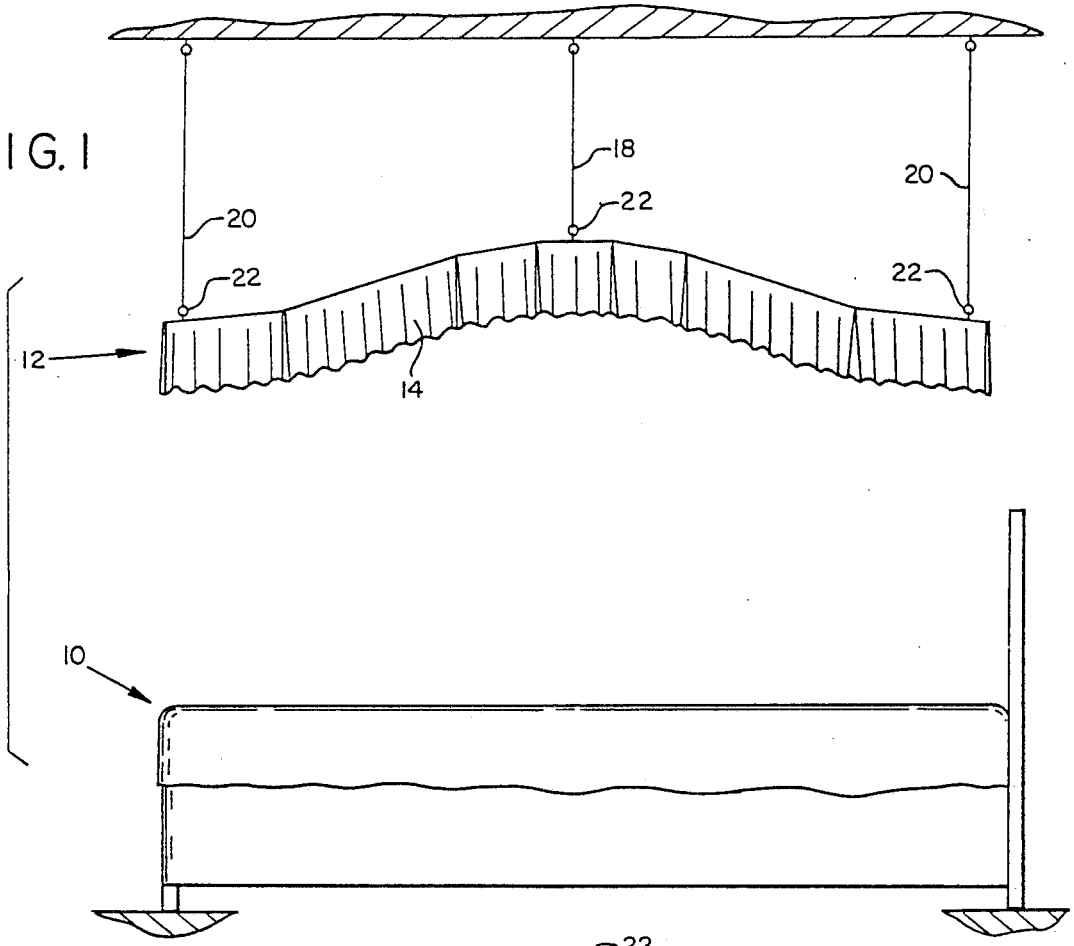
FIG. 2
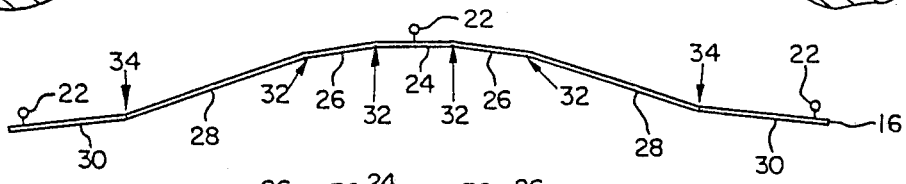
FIG. 3
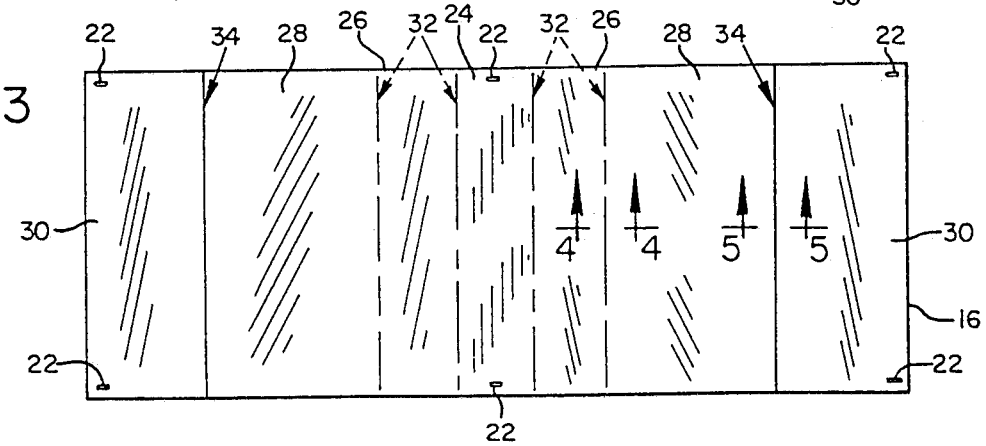
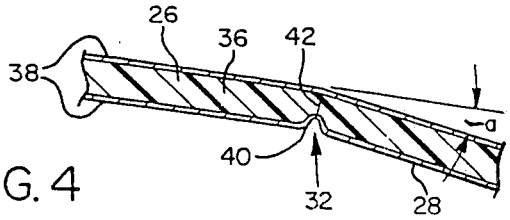
FIG. 4
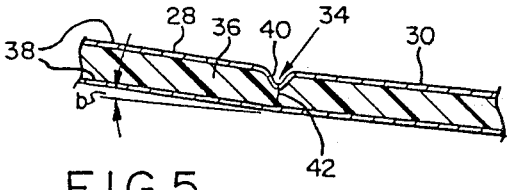
FIG. 5

CEILING SUSPENDED BED CANOPY

This application is a continuation of application Ser. No. 822,572; filed Jan. 27, 1986 now abandoned.

BACKGROUND OF THE INVENTION

This invention relates to new and useful improvements in bed canopies.

Bed canopies have heretofore been provided which are supported on posts extending upwardly from the bed. This type of canopy structure is supported at the front and rear of the bed and thus a rather substantial or reinforced frame is required to support this long span. Thus, canopy beds are known to be quite expensive. Since this type of canopy bed is in common use, canopy covers are available for accommodating desired patterns, colors, and also for removal for laundering.

SUMMARY OF THE INVENTION

According to the present invention, a bed canopy is provided which has a novel structure capable of suspending the canopy from the ceiling in independent relation to the bed whereby to eliminate expensive supporting structure on the bed itself.

Another object is to provide a ceiling suspened canopy of the type described which is capable of removably receiving conventional canopy covers.

Still another object is to provide a canopy of the type described utilizing a novel frame which facilitates line suspension from the ceiling and which utilizes novel connecting joints and selected suspending line lengths so as to assume an arched configuration.

In carrying out these objectives, a body portion of the invention comprises a rigid or semi-rigid board suspended from the ceiling independent of the bed. In a preferred structure, the board has a substantially horizontal central section, and oppositely extending symmetrically arranged angled sections leading in opposite directions from the central section. First ceiling connected line means are attached to the central section and second ceiling connected line means are attached to the board adjacent the ends thereof to complete the suspended support of the board. The board has a novel arrangement of creases and cuts between the sections thereof to allow for an arched configuration and also to allow folding. The second line means are longer than the first line means to hold the body portion in its arched configuration.

The invention will be better understood and additional objects and advantages will become apparent from the following description taken in connection with the accompanying drawings.

BRIEF DESCRIPTION OF THE DRAWINGS

FIG. 1 is a side elevational view of a conventional bed utilized in combination with a canopy of the present invention, the canopy being shown with a conventional cover thereon;

FIG. 2 is a side edge view of a body portion or frame of the instant invention, the canopy cover being omitted from the view;

FIG. 3 is a top plan view of the body portion of FIG. 2; and

FIGS. 4 and 5 are enlarged fragmentary sectional views taken on the lines 4—4 and 5—5 of FIG. 3 respectively.

DETAILED DESCRIPTION OF A PREFERRED EMBODIMENT

With reference first to FIG. 1, the numeral 10 designates a conventional bed and the numeral 12 designates the present canopy suspended from the ceiling over the bed. The canopy has a conventional cover 14 and it is preferably constructed dimension-wise to receive covers that are on the market.

With reference to FIGS. 1, 2 and 3, the body portion or frame 16 for the present canopy comprises an elongated board arranged to be suspended from the ceiling by one or more centrally located lines 18, FIG. 1, and end lines 20. The lines 20 are longer than the lines 18, and with the body portion 16 constructed of a rigid material in a novel manner it can support the cover 14 and yet bend to an arched position.

In a preferred construction, the body member is constructed of one-piece rigid material and consists of a plurality of angled sections which in the whole can assume a rounded or arched appearance when suspended. Such is accomplished by a novel arrangement of angled sections and the joints therebetween. More particularly, the body portion comprises a central section 24 and a section 26 leading in a downward angular relation from each end of the section 24. The two sections 26 are symmetrical. Leading in a downward angle from sections 26 are sections 28, the latter sections also being symmetrical. Symmetrical end sections 30 lead from the respective sections 28. Sections 30 angle upwardly relative to sections 28 but lead downwardly relative to the horizontal or possibly close to horizontal.

In utilizing a rigid board, the arched configuration thereof is accomplished by transverse bottom joints 32 between the sections 24 and 26 and between sections 26 and 28 and transverse top joints 34 between the sections 28 and 30. The angular relationship of the sections is such that the section 24 is substantially horizontal, the sections 26 are angled downwardly a slight amount relative thereto, the sections 28 are angled down slightly relative to sections 26 and the sections 30 are angled up relative to sections 28.

A rigid paper covered board, such as foam board or cardboard, serves effectively as the body portion 16. That is, a board having a rigid core layer 36 and tough paper outer layers 38 secured thereto can be supported by lines 18 and 20 in an arched configuration without collapsing between the support lines from its own weight and from the weight of the cover 14. For purposes of illustration the enlarged section views FIGS. 4 and 5 illustrate the use of a foam board wherein a core portion of plastic foam 36 is secured integrally between surface layers 38 of a tough high tensile strength paper. With special bottom joints 32 between the sections 24 and 26 and between sections 26 and 28 and top joints between sections 28 and 30, now to be described, this board is adapted to assume an arched configuration when supported by the different length lines 18 and 20.

Each of the joints 32 and 34 comprises a transverse crimp 40, with the crimps 40 for the joints 32 being made in the bottom paper layer 38 and partly into the core, and the crimps 40 for the joints 34 being made in the top paper layer 38 and partly into the core. These crimps form a transverse weakened area at the joints to allow for the bend in the board at these joint areas. Such crimps, although allowing for the bend of the joints to take place, maintain a strong connection at such joints due to the high tensile strength of the layers 38. The core portion 36 will compress slightly at the crimps and assist in the prevention of downward bowing or collapse. The angle designation a identifies the angle of bend between inner sections 24, 26 and 28 and the angle designation b identifies the angle of bend between outer sections 28 and 30.

It is also desirable to provide some of the joints 32 and 34 with full width cuts 42 which extend through paper layer 38 at the crimps 40 and into the core 36. These cuts terminate at or slightly short of the opposite paper layer so that the latter paper layer can maintain a tensile connection at the joint. With cuts made, for example, at the two outer joints 34 and at the joints 32 between the sections 26 and 28, the sections 30 can be folded under and the sections 28 folder over the top to provide a compact article for packaging and shipment.

With the canopy suspended by means of the lines 18 and 20 and with the lines 20 being longer than the lines 18, the arched shape as shown in FIG. 1 will be maintained by the joints of the rigid body portion sections.

According to the invention, an inexpensive but attractive canopy is provided for beds that do not have the canopy frame supported thereon. At the same time, the suspended canopy, although independent of the bed, serves the same purpose as bed mounted canopies. The lines 18 and 20 preferably are light gauge and transparent and thus almost invisible to provide a floating appearance.

It is to be understood that the form of our invention herein shown and described is to be taken as a preferred example of the same and that various changes in the shape, size and arrangement of parts may be resorted to without departing from the spirit of our invention, or the scope of the subjointed claims.

Having thus described our invention, we claim:

1. A bed canopy comprising:

a body portion having opposite ends, side edges, and top and bottom surfaces, said body portion being arranged to receive and support a canopy cover, said body portion being formed of a substantially rigid laminated board comprising an inner core of plastic foam and top and bottom layers of high tensile strength paper secured integrally thereto, said body portion having a substantially horizontal central section with opposite ends, downwardly angled sections leading from said central section in connected joints at least one said downwardly angled section between said central section and each of said opposite ends, the paper layer and core being crimped transversely on the bottom surface at said joints to allow said sections to assume their angular position, said body portion also having upwardly angled end sections leading from said downwardly angled sections in connected joints and terminating in said opposite ends, the paper layer and core in the connected joints between said downwardly angled sections and said upwardly angled sections being crimped transversely on the top surface of said joints to allow said upwardly angled sections to assume their angular position, and line means comprising first suspension lines attached to said central section for supporting the latter from a ceiling and second suspension lines attached to said end sections adjacent said opposite ends, said second suspension lines being longer than said first suspension lines wherein said jointed sections are arched between said opposite ends, said arched configuration of said body portion between at least some of said sections being maintained at least partly by the tensile strength of said paper layer on the opposite surface of said body portion from said crimp and by compression of said plastic foam at said joint.

2. The bed canopy of claim 1 wherein some of said joints are cut through one paper layer and at least partly through said core at said crimps to allow folding of said sections together into a compact unit.

* * * * *